US005290325A

United States Patent [19]

Kanne et al.

[11] Patent Number: 5,290,325

[45] Date of Patent: Mar. 1, 1994

[54] HYDROCARBON FUEL COMPOSITION CONTAINING ALPHA-KETOCARBOXYLATE ADDITIVE

[75] Inventors: Diane D. Kanne, Yorba Linda; William M. Fruscella, Corona, both of Calif.

[73] Assignee: Union Oil Company of California, Los Angeles, Calif.

[21] Appl. No.: 486,074

[22] Filed: Feb. 28, 1990

[51] Int. Cl.[5] ..... C10L 1/18

[52] U.S. Cl. ..... 44/400; 44/401; 44/451

[58] Field of Search ..... 44/77, 57, 400, 401, 44/451

[56] References Cited

U.S. PATENT DOCUMENTS

| | | | |
|---|---|---|---|
| 1,582,420 | 4/1926 | Nikaido . | |
| 2,128,987 | 9/1938 | Christensen . | |
| 2,221,839 | 11/1940 | Lipkin . | |
| 2,316,012 | 4/1943 | Miller | 44/77 |
| 2,327,835 | 8/1943 | White . | |
| 2,328,711 | 9/1943 | Crandall et al. | 44/77 |
| 2,763,537 | 9/1956 | Barusch et al. . | |
| 2,840,613 | 6/1958 | Howk et al. . | |
| 2,841,479 | 7/1958 | Hefner et al. . | |
| 3,074,787 | 1/1963 | Eckert et al. | 44/385 |
| 3,258,496 | 6/1966 | Kesslin et al. . | |
| 3,318,812 | 5/1967 | Coffield . | |
| 3,349,043 | 10/1967 | Manning et al. | 44/77 |
| 3,594,138 | 7/1971 | Badin . | |
| 3,639,109 | 2/1972 | Badin | 44/77 |
| 3,658,495 | 4/1972 | Dorer et al. | 44/77 |
| 3,817,720 | 6/1974 | Moy et al. . | |
| 3,820,962 | 6/1974 | Johnson . | |
| 3,857,897 | 12/1974 | Findeisen et al. . | |
| 3,869,262 | 3/1975 | Mayerhoffer et al. . | |
| 3,876,708 | 4/1975 | Speh et al. . | |
| 3,892,681 | 7/1975 | Edwards et al. | 252/8.6 |
| 3,903,006 | 9/1975 | Elliott et al. . | |
| 4,181,938 | 5/1965 | Eckert et al. | 44/400 |
| 4,182,910 | 1/1980 | Schmidt et al. . | |
| 4,240,801 | 12/1980 | Desmond, Jr. . | |
| 4,261,702 | 4/1981 | Sweeney . | |
| 4,302,214 | 11/1981 | Sweeney . | |
| 4,333,739 | 6/1982 | Neves . | |
| 4,354,855 | 10/1982 | Sweeney | 44/77 |
| 4,385,904 | 5/1983 | Sowicki et al. | 44/77 |
| 4,390,344 | 6/1983 | Sweeney . | |
| 4,390,417 | 6/1983 | Sweeney . | |
| 4,395,267 | 7/1983 | Sweeney . | |
| 4,397,655 | 8/1983 | Sweeney . | |
| 4,541,837 | 9/1985 | Norten . | |
| 4,647,288 | 3/1987 | Dillon . | |
| 4,647,292 | 3/1987 | Jessup et al. | 44/66 |
| 4,723,964 | 2/1988 | Jessup et al. | 44/57 |
| 4,738,686 | 4/1988 | Dillon et al. | 44/57 |
| 4,740,215 | 4/1988 | Dillon et al. | 44/57 |
| 4,743,273 | 5/1988 | Croudace et al. | 44/71 |
| 4,781,728 | 11/1988 | Jessup et al. | 44/56 |
| 4,804,487 | 2/1989 | Reed et al. | 252/400.1 |
| 4,891,049 | 1/1990 | Dillon et al. . | |
| 4,904,279 | 2/1990 | Kanne et al. . | |
| 5,004,480 | 4/1991 | Kanne . | |

OTHER PUBLICATIONS

"Carboxylic Ortho Acid Derivatives," DeWolfe, *Organic Chemistry: A Series of Monographs*, Ed. Blomquist, vol. 14, Academic Press, 1970, (pp. 2, 3, 56, 57, 64, 65, 70, 71, 120, 121, and 134–146.

SEA Technical Paper Series, No. 902173, "The Effects of Diesel Ignition Improvers in Low-Sulfur Fuels on Heavy-Duty Diesel Emissions," Lawrence J. Cunningham, Timothy J. Henley, & Alexander M. Kulinowski, International Fuels and Lubricants Meeting and Exposition, Tulsa, Oklahoma, Oct. 22–25, 1990.

"Advances in Diesel Particulate Control," SP-816, Society of Automotive Engineers, Inc., Feb. 1990, pp. 35–66, 79–86.

Stinson, Karl W., *Diesel Engineering Handbook*, 10th Ed., Diesel Publications, Inc., Stamford, Conn., p. 112 (1959).

*Primary Examiner*—Margaret Medley

*Attorney, Agent, or Firm*—Gregory F. Wirzbicki; William M. Dooley

[57] ABSTRACT

Hydrocarbon fuels, especially diesel fuel compositions, contain alpha-ketocarboxylate additives such as methyl pyruvate to reduce particulate emissions therefrom when combusted in an internal combustion engine. The additives are preferably non-aromatic and metals-free.

40 Claims, No Drawings

HYDROCARBON FUEL COMPOSITION CONTAINING ALPHA-KETOCARBOXYLATE ADDITIVE

BACKGROUND OF THE INVENTION

This invention relates to organic additives for suppressing particulate emissions and to hydrocarbon fuels containing the additives. These additives are useful for reducing soot, smoke and particulate emissions from combustion of hydrocarbon fuels.

SUMMARY OF THE INVENTION

The present invention resides in a hydrocarbon fuel composition having properties for suppressing emissions of particulates which comprises a hydrocarbon fuel and a sufficient amount of at least one alpha-ketocarboxylate ester so as to reduce the amount of particulate emissions resulting from the combustion of the fuel.

DETAILED DESCRIPTION OF THE INVENTION

The present invention resides in a hydrocarbon fuel having properties for suppression of particulate emissions during combustion. In particular, the present invention relates to hydrocarbon fuel compositions comprising a hydrocarbon fuel, preferably a hydrocarbon fuel heavier than gasoline, containing an alpha-ketocarboxylate ester as an additive thereto to reduce the particulate emissions resulting from the combustion of the hydrocarbon fuel.

In the composition of the present invention, the alpha-ketocarboxylate ester has from 4 to about 40 carbon atoms total, preferably from 4 to about 20 carbon atoms, and more preferably from 4 to about 10 carbon atoms. Preferred are aliphatic alpha-ketocarboxylates, and more preferred are alkyl alpha-ketoalkanoates. Most preferably, the additive is methyl alpha-ketopropionate, which contains a total of four carbon atoms.

Alpha-ketocarboxylates useful in the practice of this invention can be conceptualized as the esterification products of alpha-ketocarboxylic acids and alcohols. It is not necessary for the purposes of this invention that the additives actually be prepared from the corresponding alpha-ketocarboxylic acids and alcohols; any synthesis that yields the desired product can be used. However, the reaction of the corresponding alpha-ketocarboxylic acid and alcohol is the presently preferred route for preparing the alpha-keto carboxylate esters useful in this invention. The alpha-ketocarboxylates are preferably metal-free and non-aromatic.

Any hydroxyl-substituted organic compound having from 1 to about 20 carbon atoms can be used as the alcohol in the preparation of the additives of this invention, including both aliphatic alcohols and aromatic alcohols or phenols. Aliphatic alcohols are preferred. These can be primary, secondary, or tertiary alcohols; straight chain, branched, cyclic, or alicyclic; monohydric or polyhydric; saturated or unsaturated; substituted or, preferably, unsubstituted. More preferred are alkanols having 1 to 10 carbon atoms, even more preferably 1 to 4 carbon atoms. Examples of useful alcohols include methanol, ethanol, ethylene glycol, n-propanol, isopropanol, propylene glycol, glycerol, n-butanol, isobutanol, sec-butanol, tert-butanol, the amyl alcohols, cyclohexanol, n-hexanol, phenol, 2-ethylhexanol, the nonyl alcohols, 1-decanol, 1-dodecanol, and cetyl alcohol. Methanol is most preferred.

Any alpha-ketocarboxylic acid having from 3 to about 20 carbon atoms can be used as the acid in the preparation of the additives of this invention, including both aliphatic acids and aromatic acids or benzoic acids. Aliphatic alpha-ketocarboxylic acids are preferred. These can be straight chain, branched, or alicyclic; saturated or unsaturated; substituted or, preferably, unsubstituted. More preferred are alpha-ketoalkanoic acids having 3 to 10 carbon atoms, even more preferably 3 to 6 carbon atoms. Examples of useful alpha-keto carboxylic acids include phenyl pyruvic acid, benzoyl formic acid, 2-ketooctanoic acid, 2-ketoheptanoic acid, 2-ketohexanoic acid, 4-methyl-2-ketopentanoic acid, 3-methyl-2-ketopentanoic acid, 3,3-dimethyl-2-ketobutanoic acid, 2-ketopentanoic acid, and 2-ketobutanoic acid. Alphaketopropionic acid (pyruvic acid), is most preferred.

Examples of alpha-ketocarboxylate compounds suitable for use in the practice of the invention are methyl pyruvate, ethyl pyruvate, n-propyl pyruvate, isopropyl pyruvate, n-butyl pyruvate, cetyl pyruvate, tert-butyl pyruvate, cyclohexyl pyruvate, phenyl pyruvate, n-amyl pyruvate, tert-amyl pyruvate, 2-hydroxyethyl pyruvate, methyl 2-ketobutanoate, cyclohexyl 2-ketopentanoate, phenyl 2-ketohexanoate, and tert-butyl 2-ketobutanoate, with methyl pyruvate being most preferred.

One method by which alpha-ketocarboxylates may be prepared is by the reaction of an alpha-ketocarboxylic acid with an alcohol in the presence of an acid catalyst. For example, methyl pyruvate may be prepared by refluxing pyruvic acid with a large excess of methanol in the presence of an acid catalyst, usually at elevated temperature and atmospheric pressure. An alternative procedure is to react the alpha-ketocarboxylic acid chloride with the alcohol.

Generally, the composition of the invention is comprised of a hydrocarbon fuel and a sufficient amount of at least one alpha-ketocarboxylate, as defined herein above, to reduce the particulate emissions from the combustion of the fuel. The alpha-ketocarboxylate additive is usually present from about 0.1 to about 49.9 weight percent, preferably from about 0.1 to about 20 weight percent, and more preferably from about 0.1 to about 10 weight percent based upon the total weight of fuel and additive. Typically, the alpha-ketocarboxylate, which is normally present as a liquid, is admixed by dissolution into the hydrocarbon fuel.

As stated above, hydrocarbon fuels useful for the practice of the present invention include normally gaseous fuels such as methane, propane and butane, light liquid fuels, i.e., gasolines, and, preferably, liquid fuels heavier than gasoline, such as residual fuels, kerosene, jet fuels, heating oils, diesel fuels, light gas oil, and heavy gas oil, light cycle gas oils, heavy cycle gas oils, and vacuum gas oils. It should be noted that any hydrocarbon fuel in which the alpha-ketocarboxylate additive can be admixed to prepare a composition in accordance with the present invention is suitable for the purposes of the present invention. More preferably, the hydrocarbon fuel is a petroleum middle distillate fuel or residual fuel, and most preferably, diesel fuel or other middle distillate.

In addition the additives of this invention can be used to reduce particulate emissions from combustion of certain fuels not derived from petroleum, such as fuels derived from vegetable oils, or of liquid hydrocarbon fuels which contain alcohols. In hydrocarbon fuels containing alcohol, the alpha-ketocarboxylate additives of the present invention usually exhibit the additional advantage of acting as cosolvents, allowing for solubility or miscibility of more alcohol in the hydrocarbon fuel-additive mixture than if the additives were not present. Alcohols typically used for blending with hydrocarbon fuels include the lower alkanols, i.e., those having from 1 to about 4 carbon atoms, and preferably only 1 hydroxyl group. Ethanol is preferred, and methanol is most preferred. Although alcohol has desirable combustion properties for use in compression ignition engines, it is normally soluble or miscible in diesel fuels only to the extent of about 0.5 volume percent, occasionally up to 1 or perhaps 2 volume percent in diesel fuels having high aromatic content. The alpha-ketocarboxylate additives of this invention allow for the miscibility of alcohol in diesel fuel in proportions up to about equal to the volume of alpha-ketocarboxylate additive in the fuel.

The most preferred distillate hydrocarbon stocks useful for preparing the fuel oil compositions of this invention are generally classified as petroleum middle distillates boiling in the range of 300° F. to 700° F. and having cloud points usually from about −78° F. to about 45° F. The hydrocarbon stock can comprise straight run, or cracked gas oil, or a blend in any proportion of straight run and thermally and/or catalytically cracked distillates, etc. The most common petroleum middle distillate fuels are kerosene, diesel fuels, aviation fuels, and some heating oils. Residual fuels, which are also a preferred hydrocarbon fuel, include non-distillate heating oils, such as Grades No. 5 and 6 fuel oils.

A typical heating oil specification calls for a 10 percent ASTM D-86 distillation point no higher than about 420° F., a 50 percent point no higher than about 520° F. and a 90 percent point of at least 540° F., and no higher than about 640° F. to 650° F., although some specifications set the 90 percent point as high as 675° F.

A typical specification for a diesel fuel includes a minimum flash point of 100° F., a boiling point range of from about 300° F. to about 700° F., and maximum 90 percent distillation point (ASTM D-86) of 640° F., i.e., 90 percent by volume boils below 640° F. (See ASTM Designation D-975.)

The hydrocarbon fuel composition of the present invention may also comprise any of the known conventional additives, such as octane improvers, cetane improvers, detergents, dyes, oxidation inhibitors, etc.

The invention further provides a concentrate for use in the liquid fuels disclosed hereinabove comprising: (a) usually from about 0.1 to 99.9 weight percent, of the hereinabove described alpha-ketocarboxylate additive and (b) the balance of a solvent for the additive that is miscible and/or capable of dissolving in the fuel.

Non-limiting examples of suitable solvents are hydrocarbon fuels such as gasoline, kerosene, diesel fuel, and the like, and hydrocarbon solvents such as hexane and heptane, and mixtures of hydrocarbon solvents, or other organic solvents such as ethers. Preferably, however, the concentrate is either an undiluted alpha-ketocarboxylate additive or a solution comprising (a) between about 10 and 50 weight percent of the hereinabove described alpha-ketocarboxylate additives and (b) a mixture in any proportions of hydrocarbon solvents selected from the group consisting of hexane, heptane, ether solvents, kerosene and diesel fuels.

The invention is further described in the following Example, which is illustrative and not intended to be construed as limiting the scope of the invention as defined in the claims.

EXAMPLE

The following example demonstrates the reduction of particulate emissions from the combustion of a gaseous hydrocarbon fuel, propane, containing methyl alpha-ketopropionate (i.e., methyl pyruvate). The procedure for measuring particulate emissions involves combusting the propane in a laminar diffusion flame which is generated and stabilized using a 1.9 centimeter (cm) diameter capillary burner. The burner consists of three concentrically positioned stainless steel tubes which have respective inner diameters of 0.4 cm, 1.1 cm and 1.8 cm. Positioned within and between these tubes are stainless steel hypodermic tubes (0.84 millimeters (mm)). Propane, the desired amount of methyl pyruvate, and nitrogen are provided through the central tube with oxygen and nitrogen provided through the middle tube. Through the outer concentric tube, a shroud of nitrogen is provided to shield the flame from atmospheric oxygen. The oxygen, nitrogen, and propane are metered into the tubes of the burner through calibrated glass rotometers. The total flow rates of oxygen and nitrogen are 0.96 and 2.35 liters per minute (1/min), respectively. Particulate emissions are measured as a function of propane flow rate as listed below in Table 1. The methyl pyruvate additive is added through a 90° "pneumatic" nebulizer and monitored with a motorized syringe pump. The burner is enclosed in a circular cross-sectional quartz chimney (7 cm inner diameter by 45 cm long) which is fitted with a filter holder for collecting particulate emissions. Test durations were 5 minutes each. Fuel was also run using no additive to provide a comparison with the present invention.

While this example demonstrates the invention using propane as the hydrocarbon fuel, it also illustrates that under combustion conditions which result in formation of particulates from hydrocarbon fuels, such as middle distillates, the amount of particulates can be reduced by adding the alpha-ketocarboxylate additives of the present invention to the fuel before combustion. Therefore, the invention is advantageously employed with fuels exhibiting relatively high particulate emissions, such as middle distillate fuels. Thus, while the invention finds use in reducing particulate emissions from the combustion of any hydrocarbon fuel, it is particularly preferable when the fuel is a middle distillate fuel (i.e. diesel fuel).

The particulate emission rates are measured by drawing the exhaust out of the chimney through a fluorocarbon-coated glass fiber filter using a rotary vane vacuum pump. The weight of particulate matter collected on the filter is determined by weighing the filter before and after the test and subtracting the former from the latter.

The results of the particulate emissions measurements are listed in Table 1.

TABLE 1

| Propane Flow Rate Liter/min | Methyl Pyruvate Mole % | Mean Partic. Emission Rate Mg/min | Particulate Reduction Percent |
|---|---|---|---|
| 0.20 | — | 10.04 | — |

TABLE 1-continued

| Propane Flow Rate Liter/min | Methyl Pyruvate Mole % | Mean Partic. Emission Rate Mg/min | Particulate Reduction Percent |
|---|---|---|---|
| 0.20 | 3.0 | 9.85 | 1.9 |
| 0.23 | — | 12.41 | — |
| 0.23 | 2.8 | 11.46 | 7.6 |
| 0.25 | — | 11.05 | — |
| 0.25 | 2.6 | 10.44 | 5.5 |

Obviously, many modifications and variations of the invention, as hereinbefore set forth, may be made without departing from the spirit and scope thereof. For example, although the invention is primarily directed to reduction of particulate emissions from the combustion of liquid hydrocarbon fuels heavier than gasoline, it can be seen that the invention can also be advantageously employed with gaseous hydrocarbon fuels such as methane, ethane, propane, acetylene, or natural gas. Also, although reference has been made to petroleum middle distillates as a preferred fuel, the invention may also be used successfully with other middle distillates, such as diesel fuels, aviation fuels, etc., which are derived from shale, coal, or tar sands. Accordingly, it is intended in the invention to enhance these and all such alternatives, modifications, and variations as fall within the spirit and scope of the appended claims.

What is claimed is:

1. A composition comprising:

a hydrocarbon fuel; and a sufficient amount of an alpha-ketocarboxylate ester additive to reduce particulate emissions from the combustion of the fuel.

2. The composition of claim 1 wherein the total amount of additive is from about 0.1 to about 20 weight percent of the total weight of the composition.

3. The composition of claim 1 wherein the total amount of additive is from about 0.1 to about 10 weight percent of the total weight of the composition.

4. The composition of claim 1 wherein the additive has from 4 to about 40 carbon atoms.

5. The composition of claim 1 wherein the additive has from 4 to about 20 carbon atoms.

6. The composition of claim 1 wherein the additive comprises an alkyl alpha-ketoalkanoate having from 4 to about 10 carbon atoms total.

7. The composition of claim 1 wherein the additive comprises methyl pyruvate.

8. The composition of claim 1 wherein the hydrocarbon fuel is selected from the group consisting of kerosene, jet fuel, heating oil, diesel fuel, light gas oil, heavy gas oil, light cycle gas oil, heavy cycle gas oil, and vacuum gas oil.

9. The composition of claim 1 wherein the hydrocarbon fuel is diesel fuel.

10. A composition comprising:

(a) a middle distillate hydrocarbon fuel; and (b) from about 0.1 to about 49.9 weight percent of a metal-free and non-aromatic additive based on the total weight of the composition, said additive comprising an alpha-ketocarboxylate ester having from 4 to about 40 carbon atoms, the composition having the property of releasing fewer particulates upon combustion than would the fuel without the additive.

11. The composition of claim 10 wherein the alpha-ketocarboxylate has from 4 to about 20 carbon atoms.

12. The composition of claim 10 wherein the additive comprises an alkyl alpha-ketoalkanoate having from 4 to about 10 carbon atoms total.

13. The composition of claim 10 wherein the additive comprises methyl pyruvate.

14. The composition of claim 10 wherein the total amount of additive is from about 0.1 to about 10 weight percent of the total weight of the hydrocarbon fuel and the additive.

15. The composition of claim 10 wherein the middle distillate fuel is diesel fuel.

16. The composition of claim 10 comprising diesel fuel and methyl pyruvate.

17. A method for reducing the particulate emissions from combustion of hydrocarbon fuel comprising combusting a composition as defined in claim 1.

18. The method of claim 17 wherein the alpha-ketocarboxylate is admixed with the hydrocarbon fuel in a proportion from about 0.1 to about 10 percent by weight of the composition.

19. The method of claim 17 wherein the hydrocarbon fuel is diesel fuel.

20. The method of claim 17 wherein the alpha-ketocarboxylate has from 4 to about 20 carbon atoms.

21. The method of claim 17 wherein the additive comprises an alkyl alpha-ketoalkanoate having from 4 to about 10 carbon atoms total.

22. The method of claim 17 wherein the additive comprises methyl pyruvate.

23. A composition comprising:

a hydrocarbon fuel; and the reaction product of an alpha-ketocarboxylic acid and an alcohol.

24. The composition defined in claim 23 wherein the hydrocarbon fuel comprises a middle distillate fuel.

25. The composition defined in claim 23 comprising the reaction product of pyruvic acid and an alcohol having from 1 to about 20 carbon atoms.

26. The composition defined in claim 23 wherein the hydrocarbon fuel comprises diesel fuel.

27. A method for reducing the particulate emissions from combustion of hydrocarbon fuel comprising combusting a composition as defined in claim 23.

28. A composition comprising:

a liquid hydrocarbon fuel;

an alpha-ketocarboxylate ester; and a dissolved alcohol in a proportion greater than that soluble in the fuel in the absence of the alpha-ketocarboxylate.

29. The composition defined in claim 28 wherein the fuel comprises a diesel fuel.

30. The composition defined in claim 28 wherein the alpha-ketocarboxylate has from 4 to about 20 carbon atoms.

31. The composition defined in claim 28 wherein the dissolved alcohol is selected from the group consisting of methanol and ethanol.

32. The composition defined in claim 28 wherein the alpha-ketocarboxylate comprises a pyruvate.

33. A method for reducing the particulate emissions from combustion of a hydrocarbon fuel comprising combusting a composition as defined in claim 8.

34. A method for reducing the particulate emissions from combustion of a hydrocarbon fuel comprising combusting a composition as defined in claim 10.

35. A method for reducing the particulate emissions from combustion of a hydrocarbon fuel comprising combusting a composition as defined in claim 12.

36. The method of claim 35 wherein the composition comprises diesel fuel.

37. The method of claim 36 wherein the composition comprises from about 0.1 to about 10 weight percent of said alkyl alpha-ketoalkanoate.

38. A method for reducing the particulate emissions from combustion of a hydrocarbon fuel comprising combusting a composition as defined in claim 29.

39. The method of claim 38 wherein the alpha-ketocarboxylate has from about 4 to about 20 carbon atoms total.

40. A method for reducing the particulate emissions from combustion of a hydrocarbon fuel comprising combusting a composition as defined in claim 31.

* * * * *